US011446834B2

(12) United States Patent
Liu

(10) Patent No.: US 11,446,834 B2
(45) Date of Patent: Sep. 20, 2022

(54) TRIGGER KNIFE

(71) Applicant: ABLE TREASURE ENTERPRISE LIMITED, Hong Kong (CN)

(72) Inventor: Jia Jie Liu, Guangzhou (CN)

(73) Assignee: ABLE TREASURE ENTERPRISE LIMITED, Hong Kong (CN)

( * ) Notice: Subject to any disclaimer, the term of this patent is extended or adjusted under 35 U.S.C. 154(b) by 18 days.

(21) Appl. No.: 17/117,135

(22) Filed: Dec. 10, 2020

(65) Prior Publication Data

US 2022/0072722 A1 Mar. 10, 2022

(30) Foreign Application Priority Data

Sep. 4, 2020 (CN) ..... 202010921197.8

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01)

(58) Field of Classification Search
None
See application file for complete search history.

(56) References Cited

U.S. PATENT DOCUMENTS 7,322,110 B2 * 1/2008 Hernandez ..... B26B 5/003 30/162
8,307,556 B2 * 11/2012 Davis ..... B26B 5/003 30/162
8,776,380 B1 * 7/2014 Quimby ..... B26B 5/003 30/158
9,908,247 B2 * 3/2018 Herlitz ..... B26B 1/08
10,245,736 B2 * 4/2019 Huang ..... B26B 5/001
10,583,572 B2 * 3/2020 Herlitz ..... B26B 1/08
10,800,053 B1 * 10/2020 Liu ..... B26B 5/003
11,084,178 B2 * 8/2021 Huang ..... B26B 5/003
11,254,020 B2 * 2/2022 Liu ..... B26B 1/10
2010/0212164 A1 * 8/2010 Garavaglia ..... B26B 5/001 30/162
2016/0279811 A1 * 9/2016 Huang ..... B26B 1/08
2018/0281209 A1 * 10/2018 Landwehr ..... B26B 5/003
2022/0072722 A1 * 3/2022 Liu ..... B26B 5/003

FOREIGN PATENT DOCUMENTS

CN 113500632 A * 10/2021
CN 216000593 U * 3/2022

* cited by examiner

*Primary Examiner* — Hwei-Siu C Payer

(57) ABSTRACT

A trigger knife, including a knife housing, a knife holder, a blade, an elastic part, a trigger, a linkage assembly, a connecting plate. When the trigger is rotated outwards, the elastic part is deformed, and the linkage assembly drives the connecting plate to move and enables the knife holder to move to a first blade ejection position. When one end of the blade is lifted, the knife holder is enabled to fit with an inner wall of the knife housing, the knife holder to move to a second blade ejection position, and the connecting plate is fastened onto the knife housing and separated from the knife holder. When the end of the blade is moved down, the knife holder is enabled to move down, the elastic part is restored from the deformation to enable the knife holder to move to a rebound position.

4 Claims, 6 Drawing Sheets

TRIGGER KNIFE

TECHNICAL FIELD

The prevent invention relates to a knife, and in particular, to a trigger knife.

BACKGROUND

A trigger knife is one of handheld safety knifes. The blade of the trigger knife can retract into the knife body, and when used, the blade of the trigger knife can extend from the knife body, thereby improving the safety of the trigger knife.

However, existing trigger knives generally have the following problems:

(1) The trigger knife is over-sensitive, and therefore the blade has begun to rebound before cutting in many cases; and (2) The structure of the trigger knife is a non-fully automatic rebound structure, and therefore the blade does not rebound automatically after leaving a cutting surface; and the safety lock structure is insecure and is prone to failures, and therefore the trigger is easy to eject and then the blade ejects suddenly, resulting in an increased injury risk of the user.

SUMMARY

To overcome disadvantages of the prior art, an objective of the present invention is to provide a trigger knife. The trigger knife has good sensitivity. The blade can automatically rebound, and the blade is not easy to rebound suddenly before cutting. In addition, the safety lock structure is secure and reliable and is not prone to failures. Therefore, the injury risk of the user can be effectively reduced, and the safety performance is high.

The objective of the present invention is achieved by using the following technical solutions:

A trigger knife includes a knife housing, a knife holder, a blade, an elastic part, and a trigger, where the knife holder is installed in a cavity of the knife housing through sliding, the blade is connected to the knife holder, the elastic part is configured to provide an elastic force for the blade to retract into the cavity of the knife housing, and the trigger is rotatably installed onto the knife housing, so that the trigger can be moved in the cavity of the knife housing and partially exposed from the knife housing;

the trigger knife further includes a linkage assembly and a connecting plate that are connected, the linkage assembly is connected to the trigger in a transmissible manner, the connecting plate is movably connected to the knife holder, two ends of the elastic part are respectively connected to the knife holder and the knife housing, the knife holder can be in moveable contact with the knife housing, and the trigger rotates in a direction close to the knife housing after being pressed by an external force, to enable the linkage assembly to drive the connecting plate to move and enable the knife holder to move to a blade ejection position, and then the blade can extend from the knife housing to effectively cut a material;

the linkage assembly includes a first rack, a first drive gear, a second drive gear, and a second rack, the first drive gear and the second drive gear are pivotally connected to the knife housing by using a rotating shaft, the number of teeth of the second drive gear is greater than the number of teeth of the first drive gear, the first rack is connected to the trigger and meshes with the first drive gear, the second rack is connected to the connecting plate and meshes with the second drive gear, and an extension direction of the second rack is the same as a sliding direction of the knife holder; and the trigger knife further includes a locking block, the locking block is movably installed onto the knife housing, and a movement track of the locking block can be staggered or intersected with a movement track of the trigger, to restrict the movement of the knife holder to lock the blade in the cavity of the knife housing.

Further, the connecting plate and the second rack are formed integrally.

Further, a guiding beveled-corner configured to fit with the knife holder is disposed on an inner wall of the knife housing, a circular arc surface and a restricting boss are disposed on the knife holder, and a projection configured to fit with the circular arc surface and a lifting beveled-surface configured to fit with the restricting boss are disposed on the connecting plate.

Further, a fastening boss is disposed on the connecting plate, and a fastening slot fitting with the fastening boss is disposed on the inner wall of the knife housing.

Further, a movable through hole is disposed on one end that is of the knife housing and that is away from the blade, the movable through hole is communicated with the cavity of the knife housing, and the locking block is rotatably installed into the movable through hole.

Compared with the prior art, the present invention has the following beneficial effects:

According to the trigger knife of the present application, the blade automatically rebounds after the edge of the blade leaves a cutting surface of the material, thereby reducing the injury risk of the user. The sensitivity of the trigger knife is relatively suitable, and therefore the blade is not easy to rebound before cutting the material. A stroke is prolonged by using the linkage assembly, so that the ejection length of the blade is long enough to cut a relatively thick material. In addition, the locking block is disposed on the knife housing, the structure is secure and reliable, and therefore the blade can be effectively locked in the cavity of the knife housing.

In the figures: 1. Knife housing; 2. Knife holder; 3. Blade; 4. Elastic part; 5. Trigger; 6. Connecting plate; 7. Locking block; 8. First rack; 9. First drive gear; 10. Second drive gear; 11. Second rack; 12. Guiding beveled-corner; 13. Circular arc surface; 14. Restricting boss; 15. Projection; 16. Lifting beveled-surface; 17. Fastening boss; 18. Fastening slot; 19. through hole.

DESCRIPTION OF EMBODIMENTS

The following further describes the present invention with reference to the accompanying drawings and specific implementations. It should be noted that, the following described embodiments or technical features may be randomly combined to form new embodiments provided that they do not conflict with each other.

Figure 1:
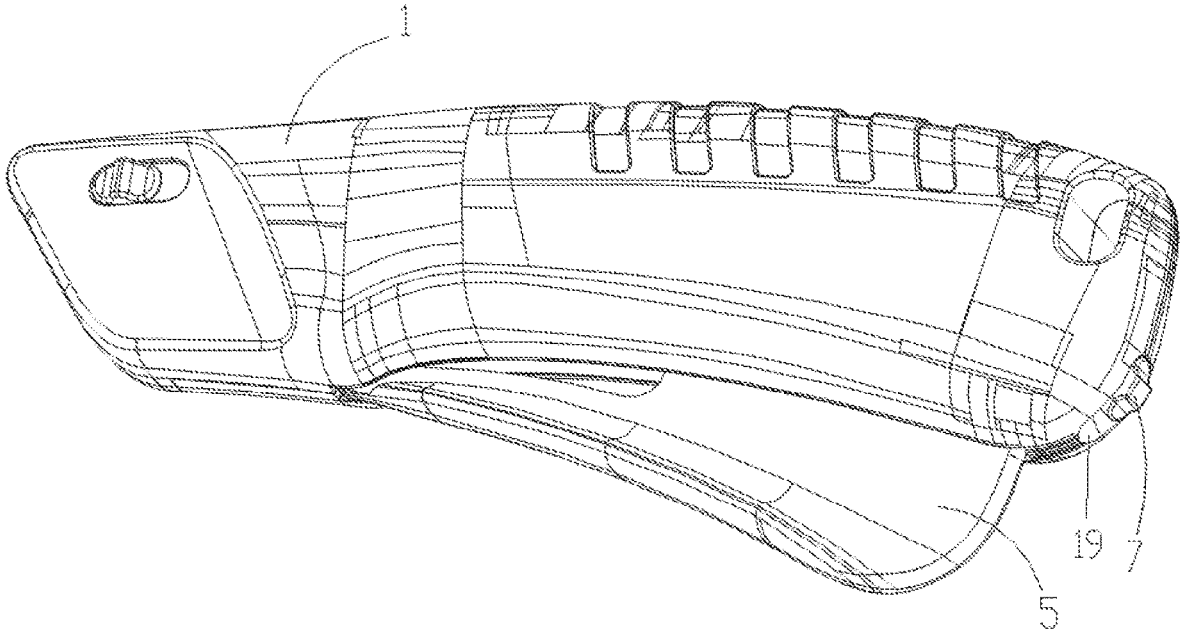
FIG. 1 is a schematic structural diagram of a trigger knife according to the present invention.
Figure 2:
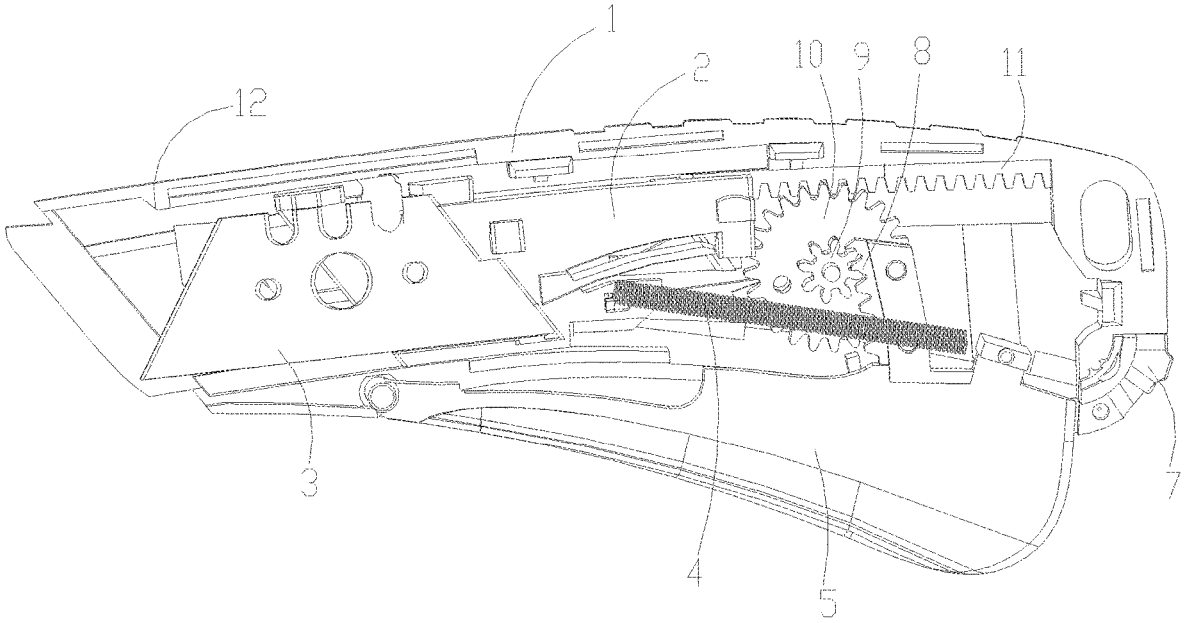
FIG. 2 is a schematic diagram of an internal structure of a trigger knife according to the present invention.
Figure 3:
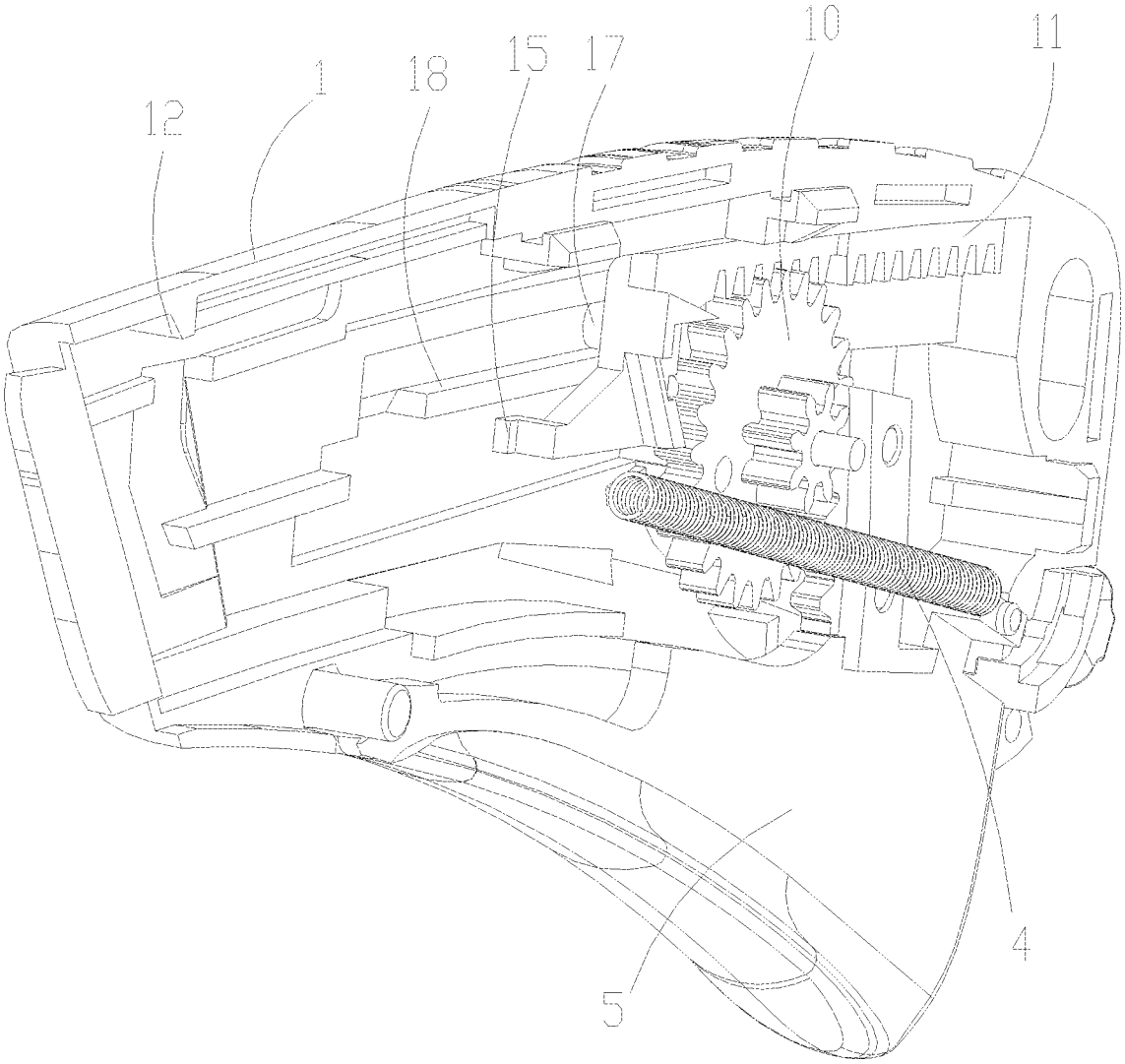
FIG. 3 is a schematic diagram of a partial structure of FIG. 2.
Figure 4:
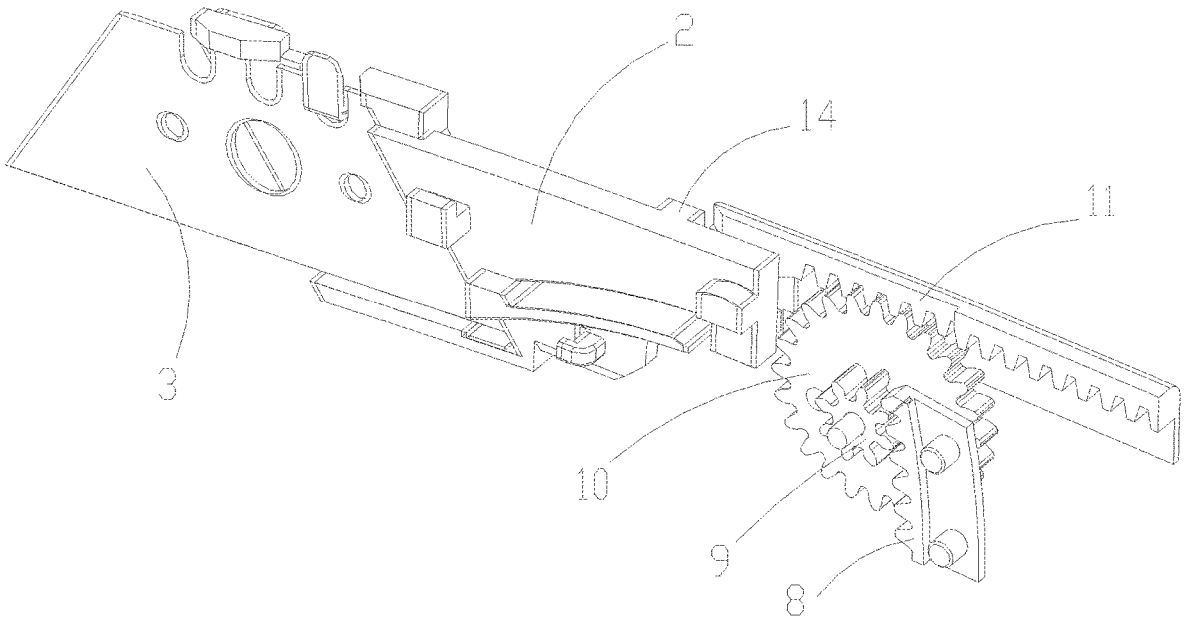
FIG. 4 is a schematic structural diagram of a linkage assembly from a view.
Figure 5:
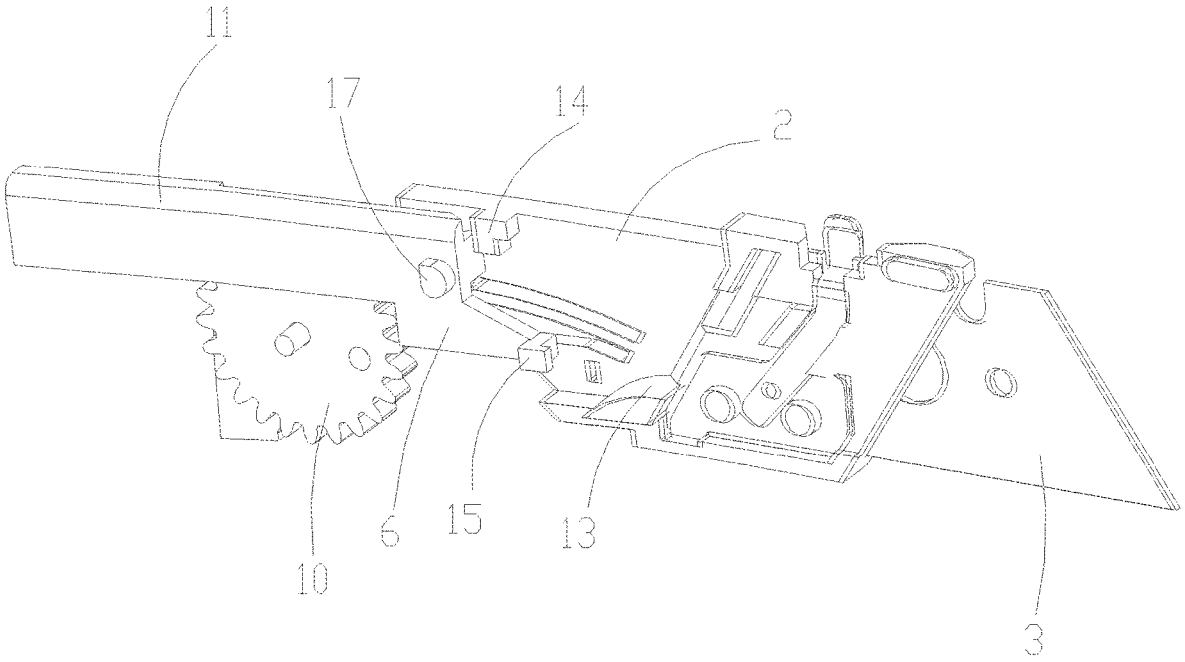
FIG. 5 is a schematic structural diagram of a linkage assembly from another view.
Figure 6:
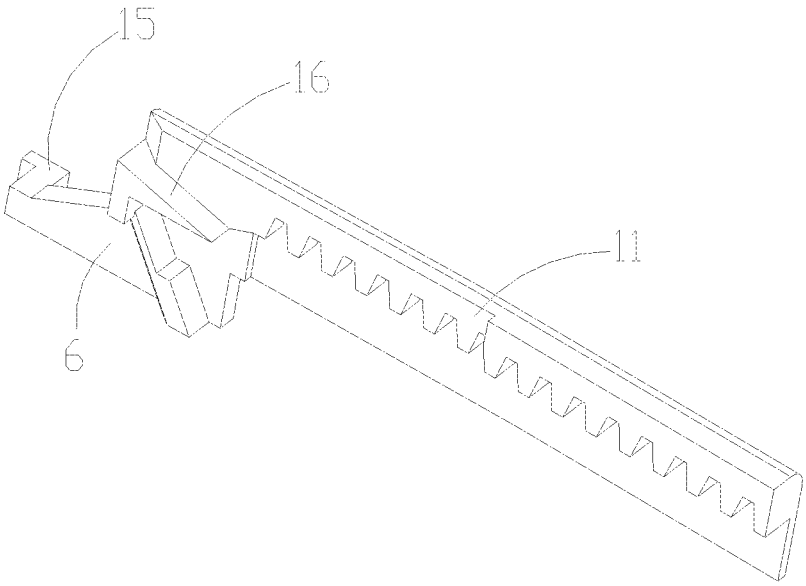
FIG. 6 is a schematic structural diagram of a second rack.

A trigger knife shown in FIG. 1 to FIG. 6 includes a knife housing 1, a knife holder 2, a blade 3, an elastic part 4, and a trigger 5. The knife holder 2 is installed into a cavity of the knife housing 1 through sliding. The blade 3 is connected to the knife holder 2. The elastic part 4 is configured to provide an elastic force for the blade 3 to retract into the cavity of the knife housing 1. The trigger 5 is rotatably installed onto the knife housing 1, so that the trigger 5 can be moved in the cavity of the knife housing 1 and partially exposed from the knife housing 1.

In this embodiment, the trigger knife further includes a linkage assembly and a connecting plate 6. The linkage assembly is connected to the trigger 5 in a transmissible manner. The connecting plate 6 is movably connected to the knife holder 2. Two ends of the elastic part 4 are respectively fastened onto the knife holder 2 and an inner wall of the knife housing 1. The knife holder 2 can be in movable contact with the knife housing 1.

Specifically, the linkage assembly is connected to the trigger 5 through meshing, and the linkage assembly is connected to the connecting plate 6.

In a preferred implementation of this embodiment, the linkage assembly includes a first rack 8, a first drive gear 9, a second drive gear 10, and a second rack 11. The first drive gear 9 and the second drive gear 10 are pivotally connected to the knife housing 1 by using a rotating shaft, and the number of teeth of the second drive gear 10 is greater than the number of teeth of the first drive gear 9. The first rack 8 is connected to the trigger 5 and meshes with the first drive gear 9. The second rack 11 is connected to the connecting plate 6 and meshes with the second drive gear 10. An extension direction of the second rack 11 is the same as a sliding direction of the knife holder 2.

In this embodiment, blade ejection positions include a first blade ejection position and a second blade ejection position. When the trigger 5 rotates in a direction close to the knife housing 1 after being pressed by an external force, the elastic part 4 is deformed, to enable the linkage assembly to drive the connecting plate 6 to move and enable the knife holder 2 to move to the first blade ejection position, and then the blade 3 can extend from the knife housing 1. When the blade 3 is in contact with a material, one end that is of the blade 3 and that is in contact with the material is lifted to enable the knife holder 2 to fit with the inner wall of the knife housing 1. The linkage assembly enables, by using the connecting plate 6, the knife holder 2 to move to the second blade ejection position, and the connecting plate 6 is fastened onto the inner wall of the knife housing 1 and separated from the knife holder 2, so that the material can be effectively cut.

When the blade 3 is not in contact with the material, the end that is of the blade 3 and that is in contact with the material is moved down to reset, to enable the knife holder 2 to move down to be separated from the inner wall of the knife housing 1. The elastic part 4 can be restored from the deformation, to enable the knife holder 2 to move to restore to a rebound position. In addition, the knife holder 2 is connected to the connecting plate 6 and enables the connecting plate 6 to be separated from the inner wall of the knife housing 1, so that the linkage assembly can drive, by using the connecting plate 6, the knife holder 2 to move to restore to an initial position, and the blade 3 can effectively retract into the cavity of the knife housing 1.

In this embodiment, the first drive gear 9 has eight teeth, the second drive gear 10 has 24 teeth, and a drive ratio of the first drive gear 9 to the second drive gear 10 is 1:3. Therefore, when the two drive gears rotate at the same angle, the stroke of the second drive gear 10 is prolonged by three times. When the first drive gear 9 travels a little stroke, the second drive gear 10 has traveled a longer stroke, and therefore can drive the second rack 11 to travel a longer stroke, so as to enable the blade 3 to extend by an enough length to effectively cut the material. The sensitivity is moderate, and therefore the blade does not begin to rebound before cutting. Likewise, when the blade 3 is not in contact with the material, the elastic part 4 is restored from the deformation, and under the action of the second rack 11, the connecting plate can drive the knife holder 2 to restore to the initial position, to enable the blade 3 to automatically retract into the cavity of the knife housing 1, thereby avoiding the risk that the user is injured when the blade 3 is in contact with the user.

In this embodiment, the linkage assembly is a gear-rack mechanism. Therefore, a rotational movement of the trigger 5 can be converted into a linear movement of the knife holder 2; in other words, the movement of the blade 3 is also enabled to be a linear movement, so that it is more labor-saving to start the trigger knife when the trigger 5 is triggered with the same stroke. Therefore, it is more convenient to start the trigger knife. In addition, the number of teeth of the second drive gear 10 is greater than the number of teeth of the first drive gear 9. Therefore, the stroke can be prolonged, so that the blade 3 can extend forwards by a longer length at the same stroke of the trigger 5. In the prior art, a trigger knife has a very short blade ejection length (10 mm), and therefore cannot cut off a relatively thick material such as a thick cardboard. However, in this embodiment, under the action of the linkage assembly, the stroke can be prolonged, to enable the blade 3 to reach a blade ejection length of 21 mm, and therefore the blade 3 can effectively cut a relatively thick material.

In addition, in this embodiment, the trigger knife further includes a locking block 7. The locking block 7 is movably installed onto the knife housing 1, and a movement track of the locking block 7 can be staggered or intersected with a movement track of the trigger 5, to restrict the movement of the knife holder 2 to lock the blade 3 in the cavity of the knife housing 1. In this way, the safety performance of the trigger knife can be effectively improved by using the safety lock structure.

It may be understood that a blade ejection opening is disposed on one end of the knife housing 1, and the blade ejection opening is communicated with the cavity, so that the blade 3 can extend from the knife housing 1 through the blade ejection opening or retract into the cavity through the blade ejection opening.

Preferably, in this embodiment, the elastic part 4 is a spring. The trigger 5 is rotatably installed onto the knife housing 1 by using a connecting shaft.

Preferably, the connecting plate 6 and the second rack 11 are formed integrally.

In a preferred implementation, a guiding beveled-corner 12 configured to fit with the knife holder 2 is disposed on the inner wall of the knife housing 1, a circular arc surface 13 and a restricting boss 14 are disposed on the knife holder 2, and a projection 15 configured to fit with the circular arc surface 13 and a lifting beveled-surface 16 configured to fit with the restricting boss 14 are disposed on the connecting plate 6.

It is worth to mention that a fastening boss 17 is disposed on the connecting plate 6, and a fastening slot 18 fitting with the fastening boss 17 is disposed on the inner wall of the knife housing 1.

In a more preferred implementation, a through hole 19 is disposed on one end that is of the knife housing 1 and that is away from the blade 3, the through hole 19 is communicated with the cavity of the knife housing 1, and the locking block 7 is rotatably installed into the through hole 19. In this way, the locking block 7 is enabled to rotate in the through hole 19, to restrict the movement of the trigger 5, thereby achieving a safety lock function and improving the safety performance of the trigger knife.

In use, the locking block 7 is enabled to rotate in a direction away from the trigger 5, to make room for the trigger 5 to rotate. In other words, the movement track of the locking block 7 is enabled to be staggered with the movement track of the trigger 5, to enable the trigger 5 to move towards the cavity of the knife housing 1.

The trigger knife is hold, to enable the trigger 5 to rotate in a direction close to the knife housing 1 after being pressed by an external force. The spring is deformed, to enable the first rack 8 to move up to drive the first drive gear 9 to rotate counterclockwise, and then enable the second drive gear 10 to rotate synchronously, so that the second drive gear 10 can drive the second rack 11 to move in a direction close to the blade ejection opening. Under the action of the restricting boss 14 on the knife holder 2, one end of the connecting plate 6 abuts against the restricting boss 14, so that the second rack 11 can push, by using the connecting plate 6, the knife holder 2 to move in the direction close to the blade ejection opening, to enable the knife holder 2 to move to the first blade ejection position, and then the blade 3 extends from the knife housing 1. When the blade 3 is enabled to be in contact with the material, the end that is of the blade 3 and that is in contact with the material is lifted up due to a reaction force of the material, and one end that is of the knife holder 2 and that is close to the blade ejection opening is lifted up simultaneously, to be in contact with the guiding beveled-corner 12. In this way, the knife holder 2 moves diagonally forwards under the guiding action of the guiding beveled-corner 12. At this time, one end that is of the knife holder 2 and that is away from the blade ejection opening abuts against the connecting plate 6, so that the knife holder 2 can drive, by using the connecting plate 6, the second rack 11 to move diagonally forwards together to the second blade ejection position. The fastening boss 17 on the connecting plate 6 can be placed into the fastening slot 18 on the inner wall of the knife housing 1, to enable the second rack 11 to be fasten onto the inner wall of the knife housing 1 by using the connecting plate 6, and enable the knife holder 2 to be separated from the connecting plate 6. This can help prevent the blade 3 from beginning to rebound before cutting the material.

Because the knife holder 2 loses a support force from the second rack 11, after the blade 3 is not in contact with the material, the end that is of the blade 3 and that is in contact with the material moves down to reset, to enable the knife holder 2 to move down to be separated from the inner wall of the knife housing 1, and the knife holder 2 moves back under the action of the spring. The knife holder 2 is moved to restore to the rebound position. At this time, the circular arc surface 13 impinges on the projection 15 of the connecting plate 6, to enable the connecting plate 6 to lift up, so that the connecting plate 6 is no longer stuck in the inner wall of the knife housing 1; in other words, the second rack 11 is enabled to be separated from the inner wall of the knife housing 1. When the trigger 5 is released, the second rack 11 begins to rebound under a pull force of the spring, to enable the second rack 11 to move in a direction away from the blade ejection opening. In this process, the lifting beveled-surface 16 on the connecting plate 6 impinges on the restricting boss 14 on the knife holder 2, to enable the knife holder 2 to lift up along the lifting beveled-surface 16. In this way, the connecting plate 6 fits with the knife holder 2, to enable the knife holder 2 to move to restore to the initial position, and the restricting boss 14 abuts against the connecting plate 6. The second rack 11 moves to reset and therefore can drive the second drive gear 10 to rotate clockwise. The first drive gear 9 rotates synchronously, to drive the first rack 8 to move down to reset, and then drive the trigger 5 to rotate in the direction away from the knife housing 1. In this way, the blade 3 can effectively retract into the cavity of the knife housing 1, so that the blade 3 can rebound automatically after leaving a cutting surface of the material.

The locking block 7 is enabled to rotate in a direction close to the trigger 5, to enable one end of the locking block 7 to enter the cavity through the through hole 19, and then enable the locking block 7 to abut against the trigger 5, so that the trigger 5 cannot move, and therefore the movement of the tool holder 2 can be restricted; in other words, the blade 3 is enabled to be locked in the cavity of the knife housing 1. The safety performance of the trigger knife can be improved by enabling the safety lock structure.

Therefore, according to the trigger knife in the embodiments of the present application, the blade 3 automatically rebounds after the edge of the blade 3 leaves the cutting surface of the material, thereby reducing the injury risk of the user. The sensitivity of the trigger knife is relatively suitable, and therefore the blade is not easy to rebound suddenly before cutting the material. The stroke is prolonged by using the linkage assembly, so that the blade ejection length of the blade 3 is long enough to cut the relatively thick material. In addition, the locking block 7 is disposed on the knife housing 1, the structure is secure and reliable, and therefore the blade 3 can be effectively locked in the cavity of the knife housing 1.

The foregoing implementations are merely preferred implementations of the present invention, and the protection scope of the present invention cannot be limited thereto. Any insubstantial changes and substitutions made by a person skilled in the art based on the present invention fall within the protection scope claimed by the present invention.

What is claimed is:

1. A trigger knife, comprising a knife housing, a knife holder, a blade, an elastic part, and a trigger, wherein the knife holder is slidably installed in a cavity of the knife housing, the blade is connected to the knife holder, the elastic part is configured to provide an elastic force for the blade to retract into the cavity of the knife housing, and the trigger is rotatably installed onto the knife housing, so that the trigger can be moved in the cavity of the knife housing and partially exposed from the knife housing;

the trigger knife further includes a linkage assembly and a connecting plate, the linkage assembly is connected to the trigger in a transmissible manner, the connecting plate is movably connected to the knife holder, two ends of the elastic part are respectively connected to the knife holder and the knife housing, the knife holder can be in moveable contact with the knife housing, and the trigger rotates in a direction close to the knife housing after being pressed by an external force, to enable the linkage assembly to drive the connecting plate to move and enable the knife holder to move to a blade ejection position, and then the blade can extend from the knife housing to effectively cut a material;

the linkage assembly comprises a first rack, a first drive gear, a second drive gear, and a second rack, the first drive gear and the second drive gear are pivotally connected to the knife housing by using a rotating shaft, the number of teeth of the second drive gear is greater than the number of teeth of the first drive gear, the first rack is connected to the trigger and meshes with the first drive gear, the second rack is connected to the connecting plate and meshes with the second drive gear, and an extension direction of the second rack is the same as a sliding direction of the knife holder;

the trigger knife further comprises a locking block, the locking block is movably installed onto the knife housing, and a movement track of the locking block can be staggered or intersected with a movement track of the trigger, to restrict the movement of the knife holder to lock the blade in the cavity of the knife housing; and a fastening boss is disposed on the connecting plate, and a fastening slot fitting with the fastening boss is disposed on an inner wall of the knife housing.

2. The trigger knife according to claim 1, wherein the connecting plate and the second rack are formed integrally.

3. The trigger knife according to claim 1, wherein a guiding beveled-corner configured to fit with the knife holder is disposed on the inner wall of the knife housing, a circular arc surface and a restricting boss are disposed on the knife holder, and a projection configured to fit with the circular arc surface and a lifting beveled-surface configured to fit with the restricting boss are disposed on the connecting plate.

4. The trigger knife according to claim 1, wherein a through hole is disposed on one end of the knife housing and away from the blade, the movable through hole is communicated with the cavity of the knife housing, and the locking block is rotatably installed into the through hole.

* * * * *